US006177164B1

(12) United States Patent
Sullens et al.

(10) Patent No.: US 6,177,164 B1
(45) Date of Patent: Jan. 23, 2001

(54) HIGH CHAIR DROP CLOTH SYSTEM

(76) Inventors: Earl R. Sullens; Sharon Denise Sullens, both of 3031 Tonti Rd., Salem, IL (US) 62881

( * ) Notice: Under 35 U.S.C. 154(b), the term of this patent shall be extended for 0 days.

(21) Appl. No.: 09/195,975

(22) Filed: Nov. 19, 1998

(51) Int. Cl.[7] ..... B32B 7/12

(52) U.S. Cl. ..... 428/40.1; 5/417; 5/438; 5/487; 15/215; 15/238; 428/41.8; 428/42.2; 428/42.3; 428/43; 428/192; 428/194; 428/906

(58) Field of Search ..... 428/40.1, 41.8, 428/42.2, 42.3, 43, 906, 192, 194; 15/215, 238; 5/487, 438, 417

(56) References Cited

U.S. PATENT DOCUMENTS 5,712,012 * 1/1998 Forman ..... 428/906

FOREIGN PATENT DOCUMENTS

2141632 * 8/1996 (CA) .

* cited by examiner

*Primary Examiner*—Nasser Ahmad

(57) ABSTRACT

A high chair drop cloth system is disclosed. The system includes a sheet of absorbent paper in a generally rectangular configuration having an upper surface and a lower surface. The system also includes a strip of adhesive material, a strip of tear-off material adapted to be positioned over the adhesive material, and a dispenser for receiving a roll of a plurality of sheet material.

1 Claim, 4 Drawing Sheets

HIGH CHAIR DROP CLOTH SYSTEM

BACKGROUND OF THE INVENTION

1. Field of the Invention

The present invention relates to a high chair drop cloth system and more particularly pertains to rendering more convenient clean-up by a child care provider after feeding time.

2. Description of the Prior Art

The use of high chair accessories is known in the prior art. More specifically, high chair accessories heretofore devised and utilized for the purpose of more convenient clean-up after feeding time are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,940,620 to Silk et al. discloses Highchair Food Collection. U.S. Pat. No. 4,483,895 to Deaver discloses an Absorbent Apron for High Chairs and the Like. U.S. Pat. No. Des. 330,988 to Robbins, III discloses a Protective Floor Mat for Use With a Chair. U.S. Pat. No. 3,445,083 to Moss discloses a Floor Mat. U.S. Pat. No. 5,127,367 to Starowitz, Jr. discloses an Animal Mat. European Patent Application No. 87307765.5 to Heuga Holding BV discloses a Floor Mat and Method of Manufacture.

While these devices fulfill their respective, particular objectives and requirements, the aforementioned patents do not describe a high chair drop cloth that allows convenient clean-up during feeding time as described herein.

In this respect, the high chair drop cloth according to the present invention substantially departs from the conventional concepts and designs of the prior art, and in doing so provides an apparatus primarily developed for the purpose of rendering more convenient clean-up by a child care provider after feeding time.

Therefore, it can be appreciated that there exists a continuing need for a new and improved high chair drop cloth which can be used for rendering more convenient clean-up by a child care provider after feeding time. In this regard, the present invention substantially fulfills this need.

SUMMARY OF THE INVENTION

In view of the foregoing disadvantages inherent in the known types of high chair accessories now present in the prior art, the present invention provides an improved high chair drop cloth. As such, the general purpose of the present invention, which will be described subsequently in greater detail, is to provide a new and improved high chair drop cloth and method which has all the advantages of the prior art and none of the disadvantages.

To attain this, the present invention essentially comprises a new and improved high chair drop cloth system for rendering more convenient clean-up by a child care provider after feeding time including a sheet of absorbent paper in a generally square configuration having an upper surface and a lower surface. The sheet is fabricated of a biodegradable paper. The lower surface is positioned on a floor beneath a high chair during feeding time. Also provided is a strip of adhesive material coupled to the periphery of the sheet on the lower surface. A strip of tear-off material is adapted to be positioned over the adhesive material and to be removed prior to use. The adhesive material ensures retained positioning of the sheet of paper in proper orientation during feeding. Also provided is a dispenser for receiving a roll of a plurality of sheets of paper with score lines between the sheets for easy separation prior to use.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved high chair drop cloth which has all of the advantages of the prior art high chair accessories and none of the disadvantages.

It is another object of the present invention to provide a new and improved high chair drop cloth which may be easily and efficiently manufactured and marketed.

It is a further object of the present invention to provide a new and improved high chair drop cloth which is of durable and reliable constructions.

An even further object of the present invention is to provide a new and improved high chair drop cloth which is susceptible of a low cost of manufacture with regard to both materials and labor, and which accordingly is then susceptible of low prices of sale to the consuming public, thereby making such high chair drop cloth economically available to the buying public.

Even still another object of the present invention is to provide a high chair drop cloth for rendering more convenient clean-up by a child care provider after feeding time.

Lastly, it is an object of the present invention to provide a new and improved high chair drop cloth system including a sheet of absorbent in a generally rectangular configuration having an upper surface and a lower surface. The system also includes a strip of adhesive material, a strip of tear-off material adapted to be positioned over the adhesive material, and a dispenser for receiving a roll of a plurality of sheet material.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
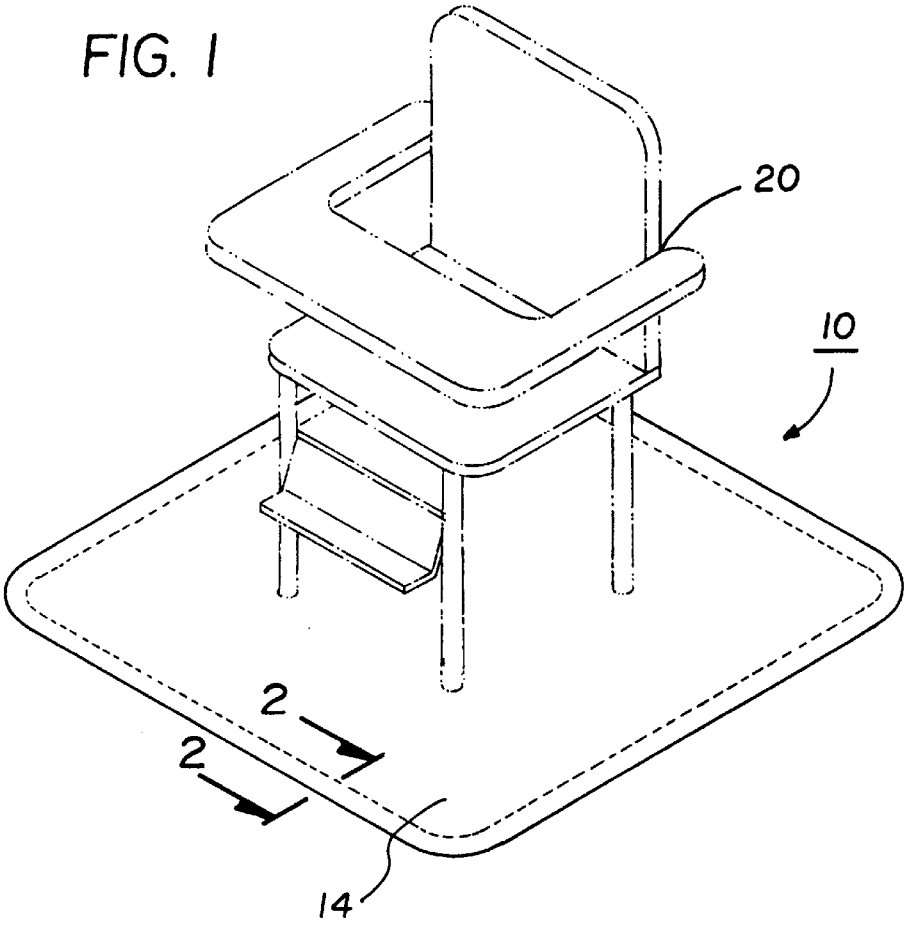
FIG. 1 is a perspective view of the preferred embodiment of the high chair drop cloth constructed in accordance with the principles of the present invention.
Figure 2:
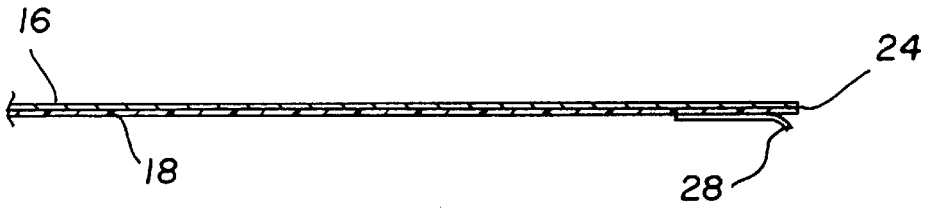
FIG. 2 is a cross-sectional view taken along line 2—2 of FIG. 1.
Figure 3:
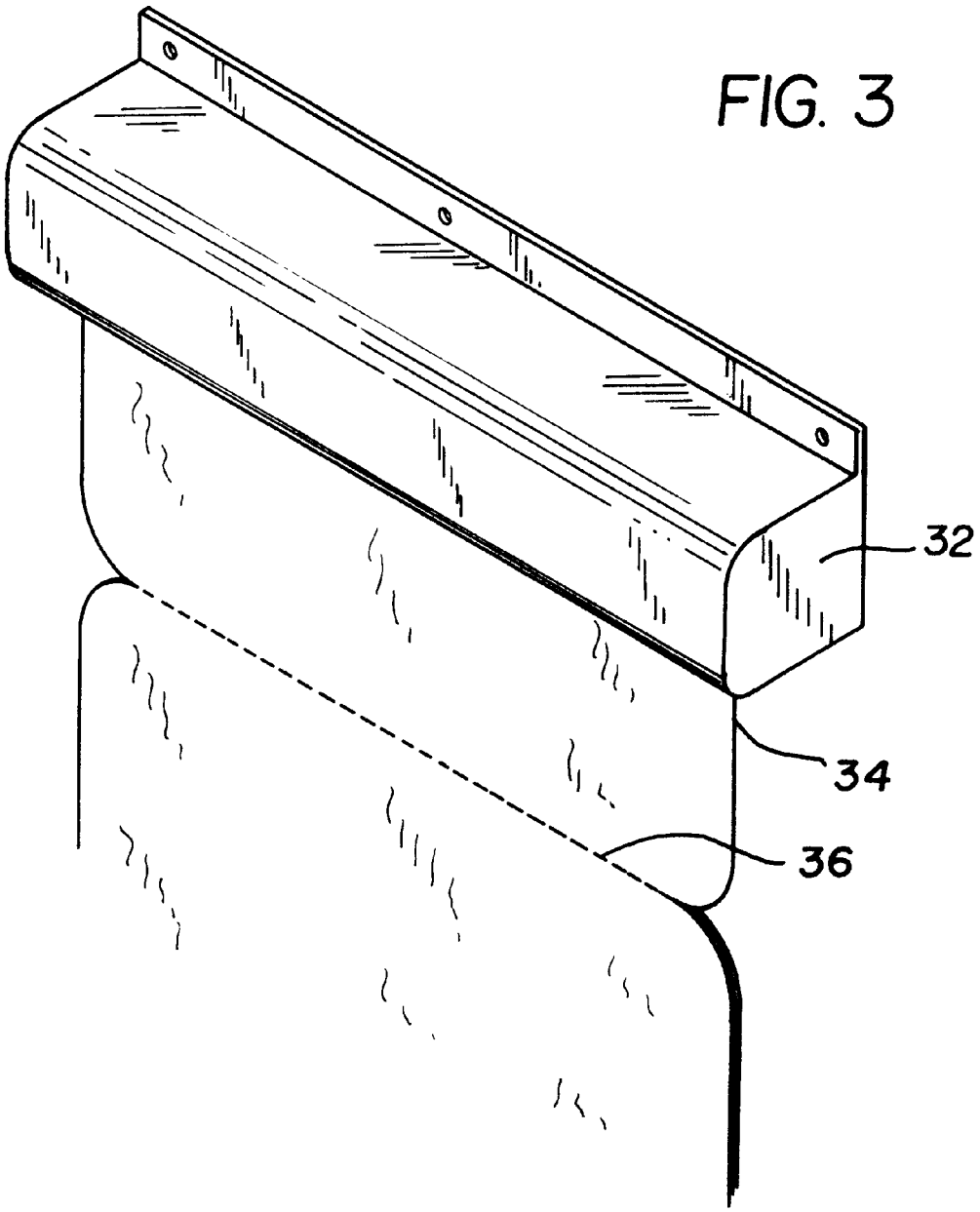
FIG. 3 is a perspective illustration of a dispenser for the sheet material shown in FIGS. 1 and 2.
Figure 4:
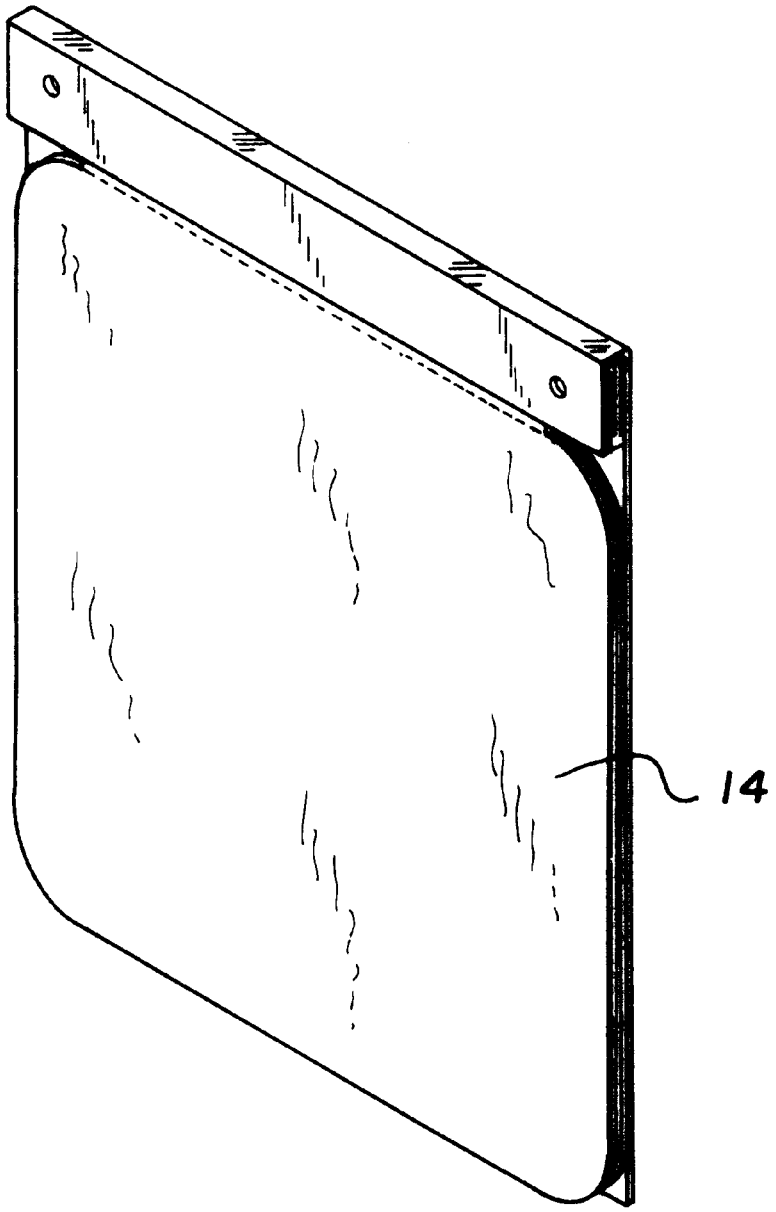
FIG. 4 is an alternate dispensing member similar to that of FIG. 3.
Figure 5:
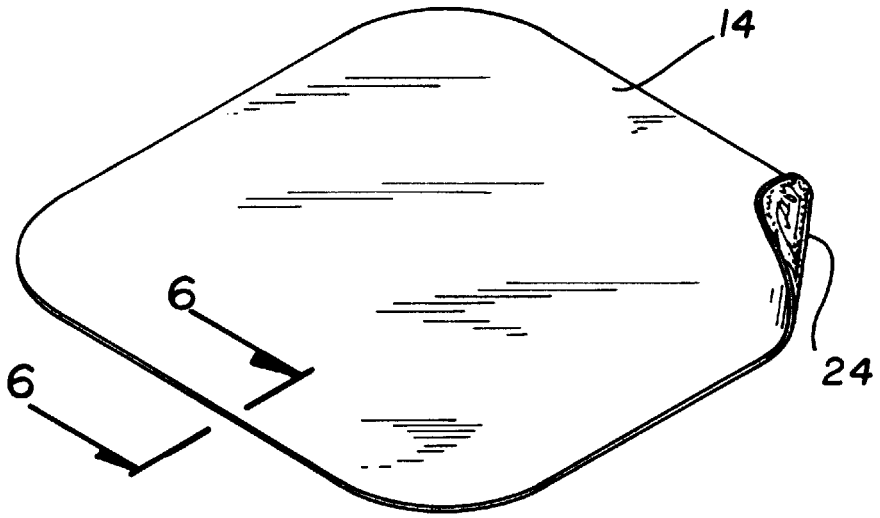
FIG. 5 is an alternate embodiment of the invention wherein the entire lower surface is formed with a pile-type fastener.
Figure 6:
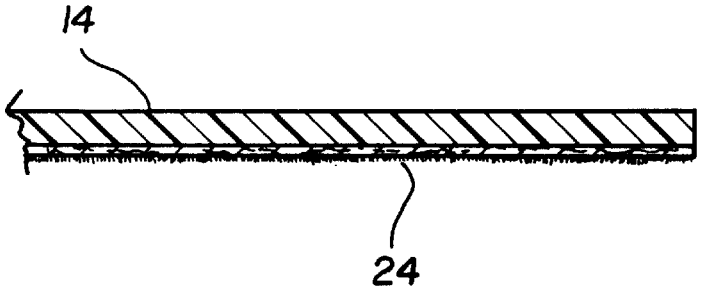
FIG. 6 is a cross-sectional view taken along line 6—6 of FIG. 5.

With reference now to the drawings, and in particular to FIG. 1 thereof, the preferred embodiment of the new and improved high chair drop cloth embodying the principles and concepts of the present invention and generally designated by the reference numeral 10 will be described.

The present invention, the high chair drop cloth system 10, is comprised of a plurality of components. Such components in their broadest context include a sheet of absorbent paper, a strip of adhesive material, a strip of tear-off material and a dispenser. Such components are individually configured and correlated with respect to each other so as to attain the desired objective.

The new and improved high chair drop cloth system 10 for rendering more convenient clean-up by a child care provider after feeding time comprises a sheet of absorbent paper 14 in a generally square configuration having an upper surface 16 and a lower surface 18. The sheet is fabricated of a biodegradable paper and the lower surface is positioned on a floor beneath a high chair 20 after feeding time.

Also provided is a strip of adhesive material 24 coupled to the periphery of the sheet on the lower surface.

Additionally provided is a strip of tear-off material 28 adapted to be positioned over the adhesive material and to be removed prior to use in order to ensure retained positioning of the sheet of paper in proper orientation during feeding.

Lastly provided is a dispenser 32 for receiving a roll 34 of a plurality of sheets of paper with score lines 36 between the sheets for easy separation prior to use.

The high chair drop cloth system as described herein is a disposable, protective mat for restaurant floors. It is designed especially to be placed beneath a child's high chair. This product can be manufactured from a thin sheet of paper or plastic, preferably a biodegradable material. It is inexpensive and lightweight, but also moisture repellant and tear-proof to protect the carpet or floor it covers.

The high chair drop cloth system could be produced and packaged in several versions such as a wall-mounted dispenser, where sheets are singled-folded, a tear-off pad, also wall-mounted, measuring about 36 inches to 40 inches square and a wall-mounted roll of 100 perforated sheets, one torn off at a time.

The system also is easily produced in many colors with names or logos imprinted thereon, if desired.

After use, the restaurant worker simply moves the empty high chair aside, bundles up the drop cloth and discards it.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. Apparatus for facilitating clean-up by a child care provider after feeding time of a child in a high chair comprising, in combination:

a high chair, a plurality of sheets of absorbent paper coupled together and maintained in a roll, each sheet being in a generally square configuration having an upper surface and a lower surface and a periphery, the sheet being fabricated of a biodegradable paper and the lower surface being positioned on a floor beneath the high chair during feeding time;

a thin continuous strip of adhesive material coupled around the entire periphery of the sheet on the lower surface;

a strip of tear-off material positioned over the adhesive material and adapted to be removed prior to use in order to ensure retained positioning of the sheet of paper in proper orientation during feeding; and a dispenser for receiving and supporting a roll of a plurality of sheets of paper, the roll including score lines between the sheets of the roll for easy separation prior to use.

* * * * *